US006608560B2

(12) United States Patent
Abrams

(10) Patent No.: US 6,608,560 B2
(45) Date of Patent: Aug. 19, 2003

(54) DEVICE AND METHOD FOR PROVIDING HVAC SERVICE ASSISTANCE

(76) Inventor: James D. Abrams, 7101 Point of Rocks Cir., Sarasota, FL (US) 34242

( * ) Notice: Subject to any disclaimer, the term of this patent is extended or adjusted under 35 U.S.C. 154(b) by 0 days.

(21) Appl. No.: 09/874,652

(22) Filed: Jun. 5, 2001

(65) Prior Publication Data

US 2002/0180590 A1 Dec. 5, 2002

(51) Int. Cl.[7] ..... G08B 1/08

(52) U.S. Cl. ..... 340/539.14; 340/539.11; 340/539.26

(58) Field of Search ..... 340/679, 604, 340/605, 534, 525, 588, 584, 585, 539, 505, 539.11, 539.14, 539.26; 700/269, 276; 702/6, 82; 714/26; 361/683, 730

(56) References Cited

U.S. PATENT DOCUMENTS 4,038,061 A 7/1977 Anderson et al.
4,827,730 A * 5/1989 Doi et al. ..... 62/127
4,903,759 A 2/1990 Lapeyrouse
5,444,436 A 8/1995 Kennison
5,596,712 A * 1/1997 Tsuyama et al. ..... 714/26
5,686,886 A * 11/1997 Stensney ..... 340/539
5,690,277 A 11/1997 Flood
5,697,224 A 12/1997 Sumida
5,816,059 A 10/1998 Ficchi, Jr. et al.
5,954,265 A 9/1999 Hall et al.
6,064,310 A 5/2000 Busak et al.
6,118,373 A 9/2000 Mandry
6,147,613 A * 11/2000 Doumit ..... 340/605
6,164,374 A 12/2000 Rhodes et al.
6,179,214 B1 1/2001 Key et al.
6,225,907 B1 * 5/2001 Derryberry et al. ..... 340/584
6,288,638 B1 * 9/2001 Tanguay et al. ..... 340/514
6,317,039 B1 * 11/2001 Thomason ..... 340/505
6,356,437 B1 * 3/2002 Mitchell et al. ..... 361/683

* cited by examiner

*Primary Examiner*—Van Trieu
(74) *Attorney, Agent, or Firm*—Senniger, Powers, Leavitt & Roedel

(57) ABSTRACT

An HVAC service assistance device assists individuals with troubleshooting their climate control systems and with contacting an HVAC contractor for service when necessary. Stored within the device is HVAC troubleshooting information that is conveniently provided to users on demand via an audio speaker and/or a visual display. The device may also store contact information for an HVAC contractor which can be conveniently accessed by the user when the climate control system next requires servicing. By recording (or having prerecorded) their contact information in the service assistance device of the present invention, HVAC contractors may increase their opportunities for receiving repeat business from customers. The service assistance device may further include a service call button which, when depressed, automatically sends a call for service to an HVAC contractor over a communication network, such as a telephone or computer network, using prerecorded contact information for the HVAC contractor.

21 Claims, 5 Drawing Sheets

DEVICE AND METHOD FOR PROVIDING HVAC SERVICE ASSISTANCE

FIELD OF THE INVENTION

The present invention relates to servicing heating, ventilation and/or air conditioning ("HVAC") systems, and more particularly to troubleshooting and scheduling service of such systems.

BACKGROUND OF THE INVENTION

It is not uncommon for an HVAC contractor, after servicing a customer's climate control system, to leave behind a sticker bearing the contractor's name and phone number. This is done in the obvious hope that the customer will reference the sticker and again call upon the HVAC contractor when the customer's climate control system is next in need of service. For best visibility, the contractor may place (or attempt to place) such a sticker on or near the customer's thermostat. However, these stickers are generally regarded as unattractive by customers. Therefore, many customers quickly remove the stickers, while others demand that they not be used in the first place. Consequently, the next time these customers require the services of an HVAC contractor, they might not call upon the same HVAC contractor as they did in the past, primarily since they might not recall which particular contractor they used. Not only does this result in lost opportunities for the contractor, it also represents an increased burden on the customer, who must bother with finding a new HVAC contractor, such as by selecting from an unfamiliar list of contractors in a telephone business directory.

On a related note, many customers try to identify the nature of any problem with their climate control system prior to calling an HVAC contractor for service. However, there is typically little if any troubleshooting information available to the customer when needed. While a product manual for a new furnace or air conditioner may contain a troubleshooting chart listing fault symptoms and possible solutions, for the average individual, the whereabouts of this product manual will be unknown when a need for the troubleshooting information arises. Similarly, some climate control devices indicate the nature of detected system faults in an encoded format using a set of indicating lights. However, determining the nature of a fault based on which lights are illuminated requires reference to a chart or table which might also provide helpful troubleshooting information, but which must first be located by the customer, if possible, when needed.

As recognized by the inventor hereof, what is needed is a means for customers to conveniently obtain HVAC troubleshooting information upon demand, for customers to readily contact an HVAC contractor when service is needed, and for HVAC contractors to increase the volume of their repeat business from customers.

SUMMARY OF THE INVENTION

In order to solve these and other needs in the art, the inventor hereof has designed an HVAC service assistance device which assists individuals with troubleshooting their climate control systems, and with contacting an HVAC contractor for service when necessary. Stored within the device is HVAC troubleshooting information that is conveniently provided to users via an audio speaker and/or a visual display in a non-encoded format that can be readily understood by users without resort to separate charts, tables, product manuals and the like. This troubleshooting information is preferably provided to users on demand, and not simply when a problem with a climate control system is detected. The service assistance device may also store contact information for an HVAC contractor, such as the name and phone number of the contractor that installed or last serviced the user's climate control system. This information can then be conveniently accessed by the user when the climate control system next requires servicing. At the same time, by recording (or having prerecorded) their contact information in the service assistance device of the present invention, HVAC contractors may increase their opportunities for receiving repeat business from customers over time. Additionally, the service assistance device may include a service call button which, when depressed, automatically sends a call for service to an HVAC contractor over a communication network, such as a telephone or computer network, using prerecorded contact information for the HVAC contractor. The service assistance device may be embodied within a thermostat for a climate control system.

According to one aspect of the present invention, a service assistance device for a climate control system includes an input device via which a user can initiate an automated call for service of the climate control system, a memory device for storing contact information for an HVAC contractor, a communication network interface for connecting the service assistance device to a communication network, and a processor operatively connected to the input device, the memory device, and the communication network interface. The processor is configured to contact the HVAC contractor, through the communication network using the communication network interface and the contact information stored in the memory device, in response to the user initiating the automated call for service via the input device.

According to another aspect of the present invention, a method of assisting a user in troubleshooting a climate control system includes the steps of providing a service assistance device having troubleshooting information for the climate control system stored therein, the service assistance device including an input device via which the user can provide a request for assistance; receiving a request for assistance provided by the user via the input device; and providing troubleshooting information for the climate control system to the user in response to the received request for assistance.

According to still another aspect of the present invention, a method of assisting a user in obtaining service for a climate control system includes the steps of providing a service assistance device having contact information for an HVAC contractor stored therein, the service assistance device including an input device via which the user can provide a request for assistance; receiving a request for assistance provided by the user via the input device; and providing the contact information for the HVAC contractor to the user in response to the received request for assistance.

According to yet another aspect of the present invention, a method for scheduling service of a climate control system includes the steps of receiving an automated call for service provided by a device in response to input from a user, the automated call for service relating to a need for service of the user's climate control system; determining contact information for the user; contacting the user using the determined contact information; and scheduling service of the user's climate control system.

According to a further aspect of the invention, a computer-readable medium has computer-executable instructions recorded thereon for implementing any one or more of the devices and methods described herein.

Other aspects and features of the present invention will be in part apparent and in part pointed out hereinafter.

BRIEF DESCRIPTION OF THE DRAWINGS

Corresponding reference characters indicate corresponding features throughout the several views of the drawings.

DETAILED DESCRIPTION OF PREFERRED EMBODIMENTS

Figure 1:
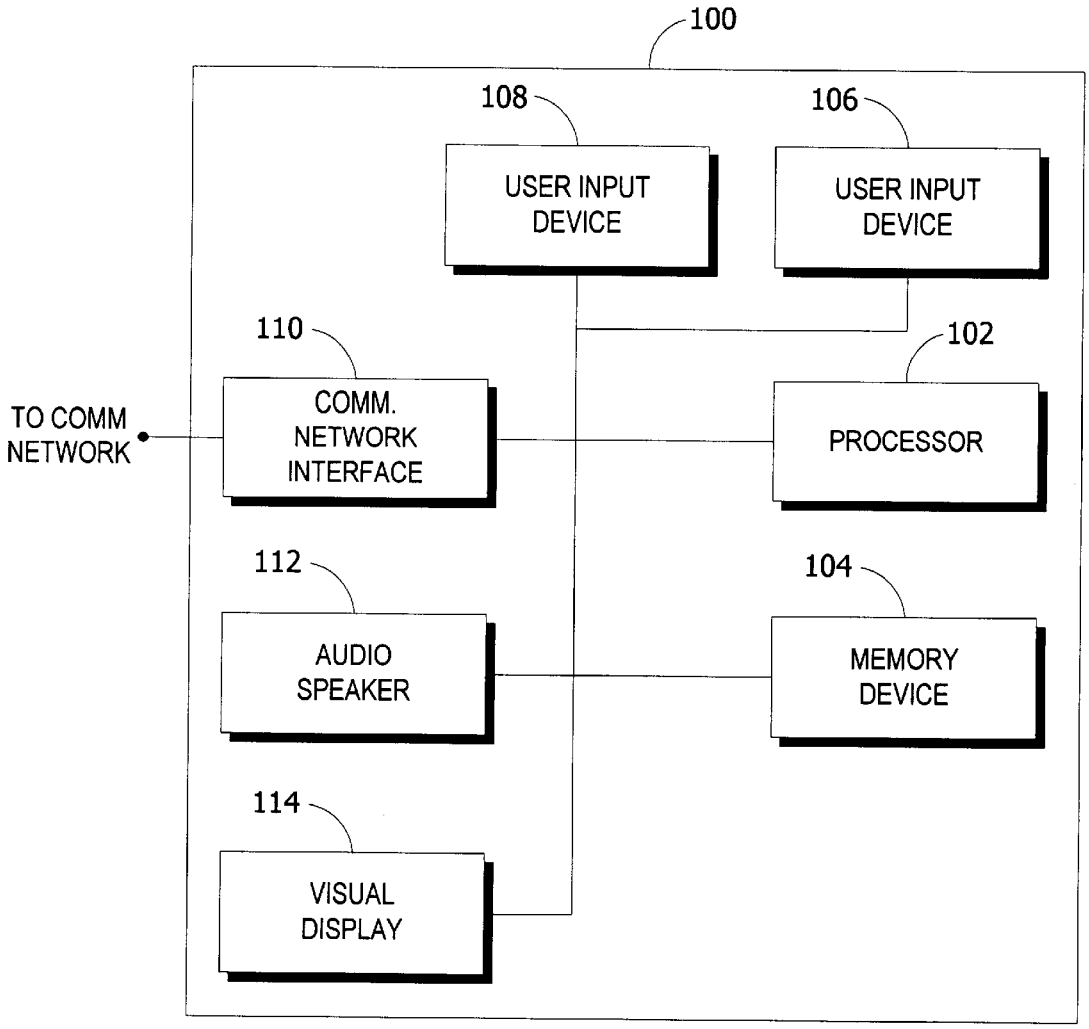
FIG. 1 is a block diagram of a service assistance device according to one embodiment of the present invention.

A device for assisting a homeowner, business owner or other user with servicing a climate control system according to one preferred embodiment of the present invention is illustrated in FIG. 1 and indicated generally by reference character 100. As shown in FIG. 1, the service assistance device 100 includes a processor 102, a memory device 104, two user input devices 106, 108, a communication network interface 110, an audio speaker 112, and a visual display 114. The processor 102 may comprise one or more computer processors. Similarly, the memory device 104 may comprise one or more static and/or dynamic memory elements, and preferably stores, among other things, computer instructions for execution by the processor 102.

As further explained below, user input devices 106, 108 are provided for a user to input a request for automated assistance and/or a call for service by a heating, ventilation and/or air conditioning ("HVAC") contractor, respectively. Preferably, the user input devices 106, 108 are push-button momentary switches, whereby a user may provide input to the service assistance device 100 simply by depressing the push-button switches as necessary. As should be apparent, however, other types of user input devices, including other types of switches, touch screens, keyboards, touch pads, mouses, joysticks, voice recognition devices, etc., can be utilized without departing from the scope of the invention. It should also be apparent from the description below that a greater or lesser number of user input devices may be employed in any given implementation of the invention.

The communication network interface 110 is provided to enable automated communications over a communication network between the service assistance device 100 and one or more remotely situated HVAC contractors. In one preferred embodiment, the communication network interface 110 is a telephone interface (e.g., a modem) for enabling automated communications with a remotely situated HVAC contractor over a telephone network. Alternatively, the communication network interface 110 may be, for example, a computer network interface device for permitting the service assistance device 100 to communicate with remote HVAC contractors through a computer network including, for example, through the Internet via email.

The audio speaker 112 and the visual display 114 are included in the service assistance device 100 for providing troubleshooting and other information to users in audio and/or visual formats. The visual display 114 is preferably a liquid crystal display (LCD).

Figure 2:
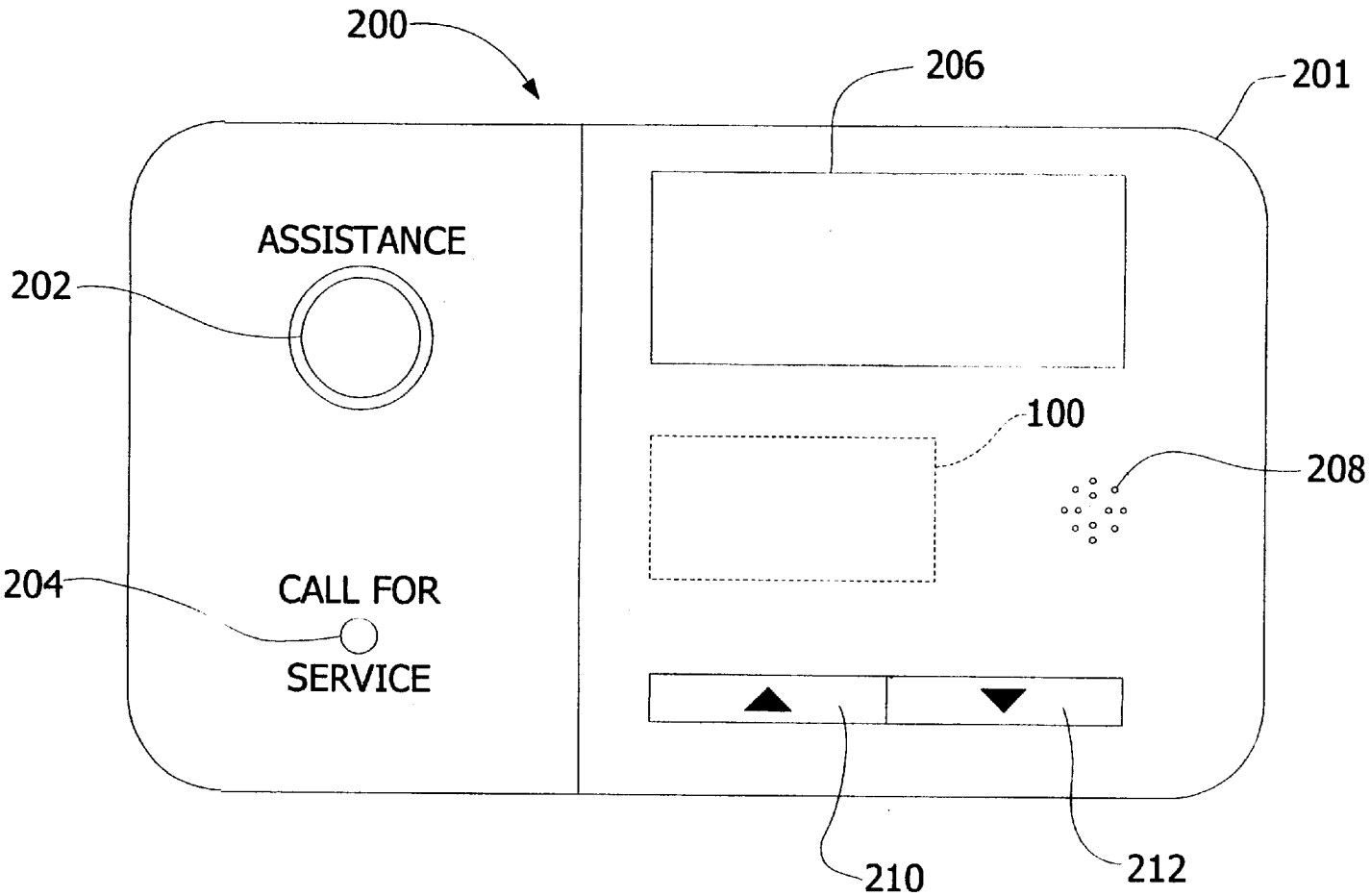
FIG. 2 illustrates the service assistance device of FIG. 1 as embodied within a thermostat for a climate control system.

As illustrated in FIG. 2, the service assistance device 100 may be embodied within a thermostat 200 for a climate control system. The thermostat 200 includes a housing 201, a push-button switch 202 (corresponding to user input device 106) by which a user can input a request for automated assistance, a push-button switch 204 (corresponding to user input device 108) by which a user can input a call for service by an HVAC contractor, an LCD 206 and an audio speaker 208. The thermostat 200 also includes up/down push-button switches 210, 212 by which a user may, for example, navigate through troubleshooting information displayed on the LCD 206. Alternatively, the service assistance device 100 may be embodied in a device other than a thermostat, or implemented as a standalone device (e.g., for installation adjacent to a thermostat for a climate control system).

A preferred manner in which the service assistance device 100 processes a user request for automated assistance will now be described with reference to the flow chart of FIG. 3. The process is initiated in block 302 of FIG. 3 when the service assistance device 100 receives a request for assistance input by a user via the user input device 106. In the case where the user input device 106 is a push-button switch, the user may preferably input the request for assistance simply by depressing the push-button switch once. In block 304, troubleshooting information is provided to the user in response to the request for assistance. This troubleshooting information is preferably stored in the memory device 104 and retrieved by the processor 102 on an as-needed basis for providing to the user, either in an audio format via the audio speaker 112, a visual format via the visual display 114, or both. Regardless of the format, the troubleshooting information is preferably provided in a readily understandable format (in contrast to an encoded format requiring resort by the user to separate charts, tables or the like for understanding).

Figure 3:
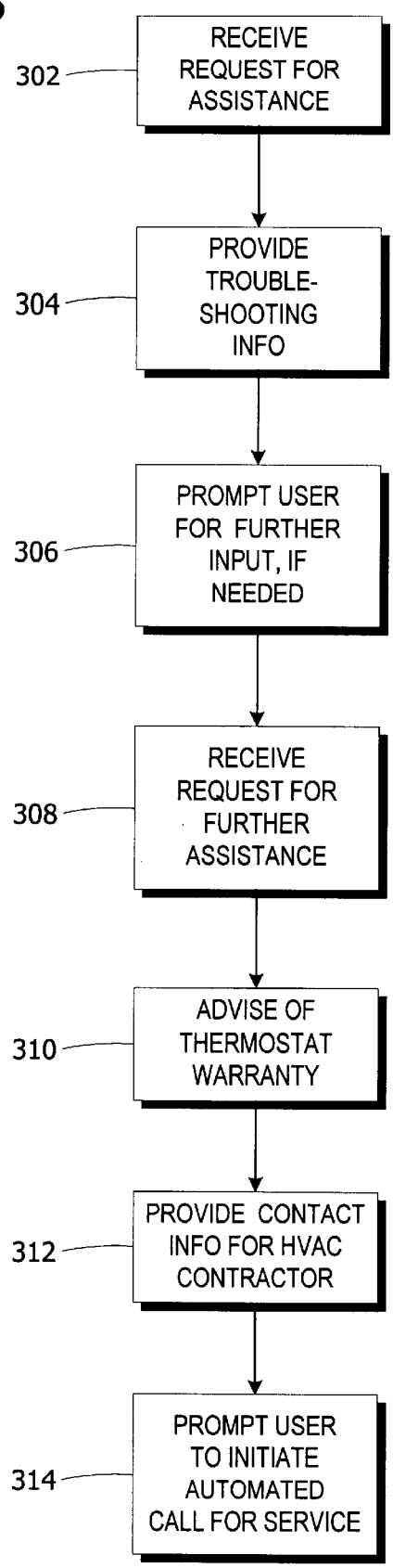
FIG. 3 is a flow chart illustrating a preferred manner in which the service assistance device of FIG. 1 processes a user request for assistance.

The troubleshooting information provided by the service assistance device 100 in block 304 of FIG. 3 may be relatively general information, such as that prompting the user to ensure that the thermostat for the climate control system is set to "on" or "auto," and/or to check an electric circuit breaker for the climate control system. More detailed troubleshooting information may also be provided, including by way of visual or voice menus through which the user can navigate to obtain any desired troubleshooting information.

In block 306 of FIG. 3, the service assistance device 100 prompts the user for further input in the event further assistance is required. For example, it may instruct the user to again depress the push-button switch 202 shown in FIG. 2 within a certain time interval, or twice (depending on the implementation), if the provided troubleshooting information does not resolve the problem with the climate control system. If input by the user, the request for further assistance is received by the service assistance device 100 in block 308 of FIG. 3.

Processing then proceeds to block 310, where the user is preferably advised that the thermostat for its climate control system is covered under a warranty. As a result, the user may be more likely to call in an HVAC contractor for servicing the climate control system, with the hope or expectation that the problem is thermostat-related and will therefore be resolved at no (or a reduced) charge to the user. In block 312 of FIG. 3, the user is provided with contact information for an HVAC contractor. This contact information is preferably stored in the memory device 104 and retrieved by the processor 102 as necessary. The contact information may include the name, phone number, post office address and/or email address of the HVAC contractor, or any other information which may assist the user with contacting the HVAC contractor for service.

By advising the user that the thermostat for the user's climate control system is covered under a warranty, and contemporaneously providing contact information for an HVAC contractor, the likelihood of the user placing a call for service to that particular HVAC contractor is markedly improved. Thus, in addition to addressing needs of the user, the service assistance device 100 of the present invention also provides a means for HVAC contractors to improve repeat-business opportunities. For example, when an HVAC contractor is called upon to install a new thermostat, the HVAC contractor may install a thermostat which embodies the service assistance device 100. The HVAC contractor may also record its name and phone number in the memory device 104 (or procure the thermostat with such information already stored therein). As a result, contact information for the installing HVAC contractor remains readily (yet inconspicuously) accessible to the user, and is advantageously provided to the user at a critical time, namely, when the user requires HVAC assistance. The likelihood that the user will call upon that particular HVAC contractor can be further improved by indicating, in the prerecorded contact information, that such HVAC contractor is authorized to perform service under the thermostat warranty, thus suggesting that other HVAC contractors might not be so authorized.

With further reference to FIG. 3, the user is preferably prompted in block 314 to initiate an automated call for service to the HVAC contractor corresponding to the contact information provided in block 312. For instance, the service assistance device 100 may instruct the user to depress the push-button switch 204 of FIG. 2 in order to place the automated call for service. Thus, if outside service is desired, the user in this particular embodiment need merely press a button to place a call for such service. In addition to simplifying for the user the service procurement process, enabling the user to initiate an automated call for service further improves the likelihood that any call for service will be directed to the particular HVAC contractor whose contact information is stored in the service assistance device 100.

A preferred manner in which the service assistance device 100 processes a user's automated call for service will now be described with reference to the flow chart of FIG. 4. The process is initiated in block 402 when the service assistance device 100 receives the automated call for service. As noted above, this automated call for service may be provided to and received by the HVAC contractor over any suitable type of communication network, including wired and wireless phone networks, computer networks, etc. The process continues in block 404 where the processor 102 preferably accesses prerecorded contact information for a particular HVAC contractor from the memory device 104. In block 406, the accessed contact information is used to contact the HVAC contractor. As an example, the accessed contact information may be a phone number for the HVAC contractor which is automatically dialed by the processor 102 working in conjunction with the communication network interface 110 (which, in this specific example, would be a telephone interface). In block 408, the service assistance device preferably provides a prerecorded message to the HVAC contractor over the communication network. This prerecorded message may include information identifying the user's name, address and/or telephone number, information identifying the user's climate control system (such as by type, serial number, date of installation, etc.), information identifying when the HVAC contractor last performed service on the user's climate control system (assuming the HVAC contractor recorded such information in the service assistance device 100 when service was last performed), etc. The prerecorded message may be a voice message, text message, series of tones or pulses, etc.

In one preferred embodiment of the invention, contact information for only one HVAC contractor is stored in the service assistance device 100. Alternatively, the device 100 may store contact information for multiple HVAC contractors, and the user may be allowed to choose among these multiple HVAC contractors when preparing to call for HVAC service.

Figure 5:
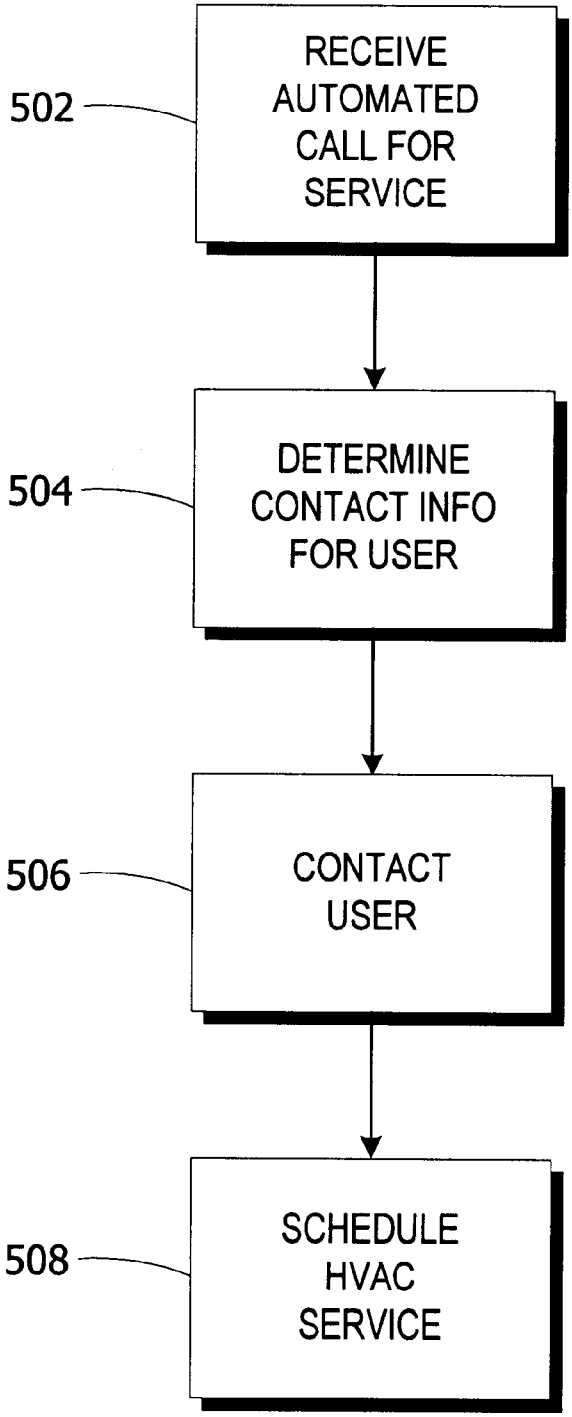
FIG. 5 is a flow chart illustrating a preferred manner in which an HVAC contractor processes a user's automated call for service.

The flow chart of FIG. 5 illustrates one preferred manner in which an HVAC contractor processes an automated call for service received from the service assistance device 100 of FIG. 1. The process is initiated in block 502 of FIG. 5 when the automated call for service is received by the HVAC contractor (including by the contractor's answering service or otherwise on behalf of the contractor). The process then continues in block 504 of FIG. 5, where the HVAC contractor determines contact information for the user associated with the automated call for service received in block 502. This contact information may be determined in a variety of ways. For example, in the case where the automated call for service is made over a telephone network, the HVAC contractor may use a caller identification service for determining the originating phone number of the user's automated call for service. If instead the automated call for service is received via email, the HVAC contractor may obtain contact information (including but not limited to a return email address for the user) from the automated email message. The HVAC contractor may also obtain contact information for the user via any prerecorded message which accompanies the user's automated call for service. Using this contact information, the HVAC contractor may contact the customer, as indicated in block 506 of FIG. 5, and then schedule service on the user's climate control system, as indicated in block 508.

Figure 4:
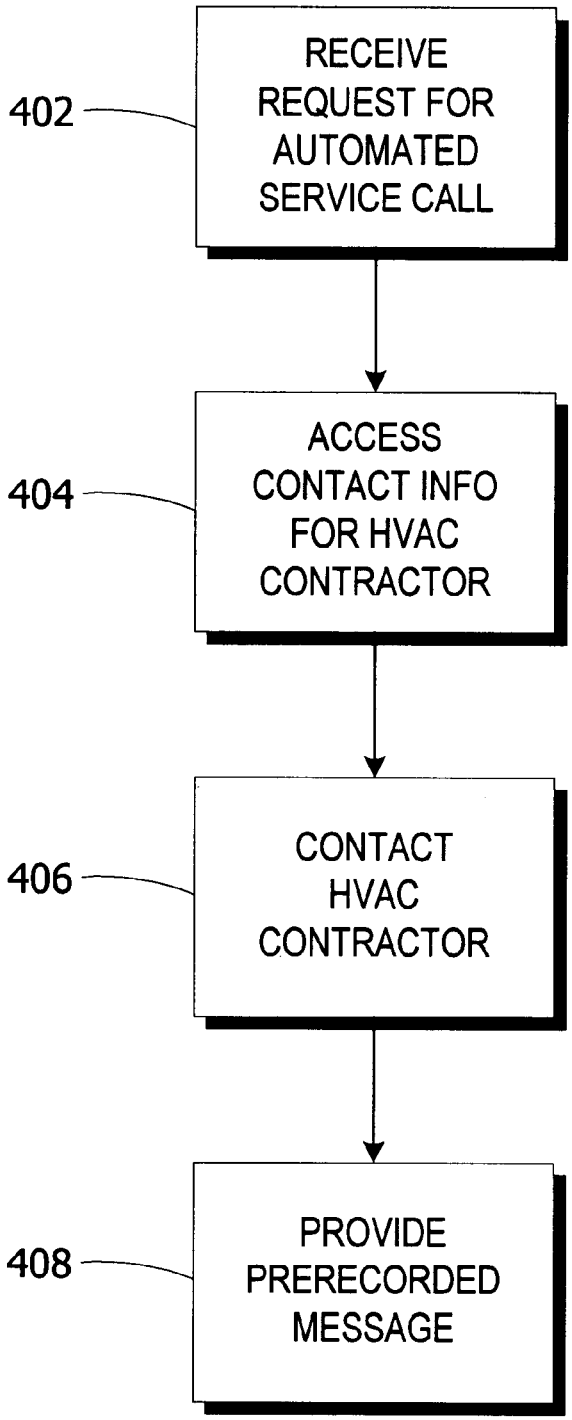
FIG. 4 is a flow chart illustrating a preferred manner in which the service assistance device of FIG. 1 processes a user's automated call for service.

While FIGS. 3, 4 and 5 illustrated the preferred steps for the processes described therein, it should be understood that many of these steps can be altered, replaced with other steps, or simply omitted in any given implementation of the invention without departing from the scope thereof.

When introducing elements or features of the present invention or the preferred embodiment(s) thereof, the articles "a", "an", "the" and "said" are intended to mean that there are one or more such elements or features. The terms "comprising", "including" and "having" are intended to be inclusive and mean that there may be additional elements or features other than those listed.

As various changes could be made in the above embodiments without departing from the scope of the invention, it is intended that all matter contained in the above description or shown in the accompanying drawings shall be interpreted as illustrative and not in a limiting sense.

What is claimed is:

1. A service assistance device for a climate control system, the service assistance device comprising:

an input device via which a user can initiate an automated call for service of the climate control system;

a memory device for storing contact information for an HVAC contractor and a prerecorded message;

a communication network interface for connecting the service assistance device to a communication network; and a processor operatively connected to the input device, the memory device, and the communication network interface, the processor being configured to contact the HVAC contractor to provide the prerecorded message to the HVAC contractor, through the communication network using the communication network interface and the contact information stored in the memory device, in response to the user initiating the automated call for service via the input device.

2. The service assistance device of claim 1 further comprising a thermostat for the climate control system, the thermostat having a housing enclosing the input device, the memory device, the communication network interface, and the processor.

3. The service assistance device of claim 1 wherein the input device is a push-button switch.

4. The service assistance device of claim 1 wherein troubleshooting information for the climate control system is stored in the memory device, and wherein the processor is configured to provide the troubleshooting information to the user in response to receiving a request for assistance from the user.

5. The service assistance device of claim 4 further comprising an input device via which the user can provide the request for assistance.

6. The service assistance device of claim 1 wherein the communication network is a telephone network and the communication network interface is a telephone network interface.

7. A method of assisting a user in obtaining service for a climate control system, the method comprising the steps of:

providing a service assistance device associated with a thermostat for the climate control system, the service assistance device including a memory device and an input device via which the user can provide a request for assistance;

storing a prerecorded audio message in the memory device, said prerecorded message containing contact information for an HVAC contractor;

receiving a request for assistance provided by the user via the input device; and playing back the prerecorded message to provide the contact information for the HVAC contractor to the user in response to the received request for assistance.

8. The method of claim 7 further comprising the step of advising the user that a thermostat for the climate control system is covered under a warranty.

9. The method of claim 8 wherein the step of providing the contact information for the HVAC contractor includes identifying the HVAC contractor as a contractor authorized to perform service under the thermostat warranty.

10. The method of claim 7 wherein the contact information for the HVAC contractor is stored in the memory device by the HVAC contractor.

11. The method of claim 7 further comprising the steps of:

sending an automated call for service to the HVAC contractor from the service assistance device in response to input from the user, the automated call for service relating to a need for service of the user's climate control system;

providing contact information for the user to the HVAC contractor via the automated call; and scheduling service of the user's climate control system by the HVAC contractor.

12. The method of claim 11 wherein the automated call for service is received over a telephone network, and wherein the contact information for the user is determined by the HVAC contractor using a caller identification service.

13. The method of claim 11 wherein the contact information for the user is determined by the HVAC contractor from a prerecorded message provided by said service assistance device.

14. The method of claim 7 wherein the thermostat has a housing and wherein providing a service assistance device includes enclosing the service assistance device in the housing of the thermostat so that the input device is externally accessible to the user.

15. The method of claim 7 wherein the input device is a switch movable by the user from a first position to a second position thereby activating playback of the prerecorded message.

16. A thermostat for a climate control system, the thermostat comprising:

a switch movable by a user from a first position to a second position;

a memory device storing a prerecorded audio message containing contact information for an HVAC contractor;

a speaker for playing back the prerecorded audio message; and a processor operatively connected to the switch, the memory device, and the speaker, the processor being configured to play back the prerecorded audio message containing contact information for the HVAC contractor through the speaker, in response to the user initiating a request for assistance relating to the climate control system by moving the switch from the first position to the second position.

17. The thermostat of claim 16 wherein said switch is a push-button switch.

18. The thermostat of claim 16 further comprising a communication network interface for connecting the thermostat to a communication network, and wherein the processor is configured to contact the HVAC contractor over the communication network in response to the user initiating a call for service of the climate control system via said switch.

19. The thermostat of claim 18 wherein the communication network is a telephone network and the communication network interface is a telephone network interface.

20. The thermostat of claim 16 wherein troubleshooting information for the climate control system is stored in the memory device, and wherein the processor is configured to provide the troubleshooting information to the user via the speaker in response to receiving a request for assistance from the user.

21. The thermostat of claim 20 further comprising an input device via which the user can provide the request for assistance.

* * * * *